US006644734B1

(12) United States Patent
Tseng

(10) Patent No.: US 6,644,734 B1
(45) Date of Patent: Nov. 11, 2003

(54) FOLDABLE TABLE AND BENCH ASSEMBLY

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/292,683

(22) Filed: Nov. 12, 2002

(51) Int. Cl.[7] ..... A47B 3/00
(52) U.S. Cl. ..... 297/158.4
(58) Field of Search ..... 297/158.4, 158.3, 297/157.1, 172; 108/169, 174, 132

(56) References Cited

U.S. PATENT DOCUMENTS 2,690,210 A * 9/1954 Holick
3,273,936 A * 9/1966 Deavers
5,921,623 A * 7/1999 Nye et al.
6,186,590 B1 * 2/2001 Tsent
6,347,831 B1 2/2002 Nye et al.
6,431,092 B1 8/2002 Stanford

* cited by examiner

*Primary Examiner*—Milton Nelson, Jr.
(74) *Attorney, Agent, or Firm*—Ladas & Parry

(57) ABSTRACT

A table and bench assembly includes a table top unit, two bench units on opposite lateral sides, and front and rear leg units. Each leg unit has an inner leg portion pivoted to the table top unit, and two outer leg portions. Each outer leg portion has an upper end provided with a slide seat mounted pivotally and slidably on one of the bench units. The slide seats slide along the bench units when the front and rear leg units are moved pivotally toward the table top unit and the bench units, thereby folding the table and bench assembly.

9 Claims, 12 Drawing Sheets

FOLDABLE TABLE AND BENCH ASSEMBLY

BACKGROUND OF THE INVENTION

1. Field of the Invention

The present invention relates to a foldable table and bench assembly, more particularly to a foldable table and bench assembly which can be converted into a compact folded state through a simple folding operation.

2. Description of the Related Art

Referring to FIGS. 1 to 3, a foldable picnic table disclosed in U.S. Pat. No. 6,347,831 is shown to include a table top 12 and two benches 18, 20 on opposite sides of the table top 12. The table top 12 is pivotally supported by two telescoping support pedestals 14, 16, and the two benches 18, 20 are pivotally supported by two telescoping bench support members 22, 26. The telescoping support pedestals 14, 16 and the telescoping bench support members 22, 26 are positionable between extended and retracted positions. When the picnic table is disposed in a picnic table configuration, the table top 12 is positioned at a plane higher than that of the benches 18, 20, as shown in FIG. 1. To dispose the picnic table in a compact state for storage, the table top 12 and the benches 18, 20 must be disposed within the same plane. As such, the telescoping support pedestals 14, 16 and the telescoping bench support members 22, 26 must be adjusted to their extended positions, as shown in FIGS. 2 and 3, such that a rotary axis of the telescoping support pedestals 14, 16 is collinear with rotary axes of the bench support members 22, 26 to permit folding of the support pedestals 14, 16 and the bench support members 22, 26 upon the table top 12 and the benches 18, 20, respectively.

SUMMARY OF THE INVENTION

The main object of the present invention is to provide a foldable table and bench assembly which can be folded through a simplified folding operation.

Accordingly, the foldable table and bench assembly of the present invention includes a table top unit, a pair of bench units, and front and rear leg units. The table top unit has front and rear end portions which are opposite to each other in a horizontal first direction, and opposite lateral sides which are opposite to each other in a horizontal second direction transverse to the first direction. The bench units are disposed on the lateral sides of the table top unit. Each of the bench units has front and rear end portions which are opposite to each other in the first direction and which are provided respectively with front and rear slide rail units. Each of the front and rear slide rail units is formed with a parallel pair of slide grooves that extend in the first direction. The front leg unit includes a pair of outer leg portions, each of which has an upper end provided with a slide seat that is mounted slidably and pivotally on the front slide rail unit of a respective one of the bench units so as to be slidable along the slide grooves in the front slide rail unit and so as to be pivotable relative to the front slide rail unit about a horizontal first pivot axis transverse to the first direction. The front leg unit further includes an inner leg portion disposed between the outer leg portions. The inner leg portion has an upper end pivoted to the front end portion of the table top unit so as to be pivotable about a horizontal second pivot axis parallel to the first pivot axis. The front leg unit further includes a connecting rod interconnecting the inner and outer leg portions of the front leg unit. The rear leg unit is spaced apart from the front leg unit in the first direction. The rear leg unit includes a pair of outer leg portions, each of which has an upper end provided with a slide seat that is mounted slidably and pivotally on the rear slide rail unit of a respective one of the bench units so as to be slidable along the slide grooves in the rear slide rail unit and so as to be pivotable about a horizontal third pivot axis parallel to the first pivot axis. The rear leg unit further includes an inner leg portion disposed between the outer leg portions of the rear leg unit. The inner leg portion of the rear leg unit has an upper end pivoted to the rear end portion of the table top unit so as to be pivotable about a horizontal fourth pivot axis parallel to the second pivot axis. The rear leg unit further includes a connecting rod interconnecting the inner and outer leg portions of the rear leg unit. The front and rear leg units are turnable pivotally between an unfolded position, in which the front and rear leg units are disposed uprightly and in which the table top unit is disposed higher than the bench units, and a folded position, in which the front and rear leg unit are folded on the table top unit and the bench units. The slide seats on the front and rear leg units are slidable along the front and rear rail units when the front and rear leg units are moved from the unfolded position to the folded position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
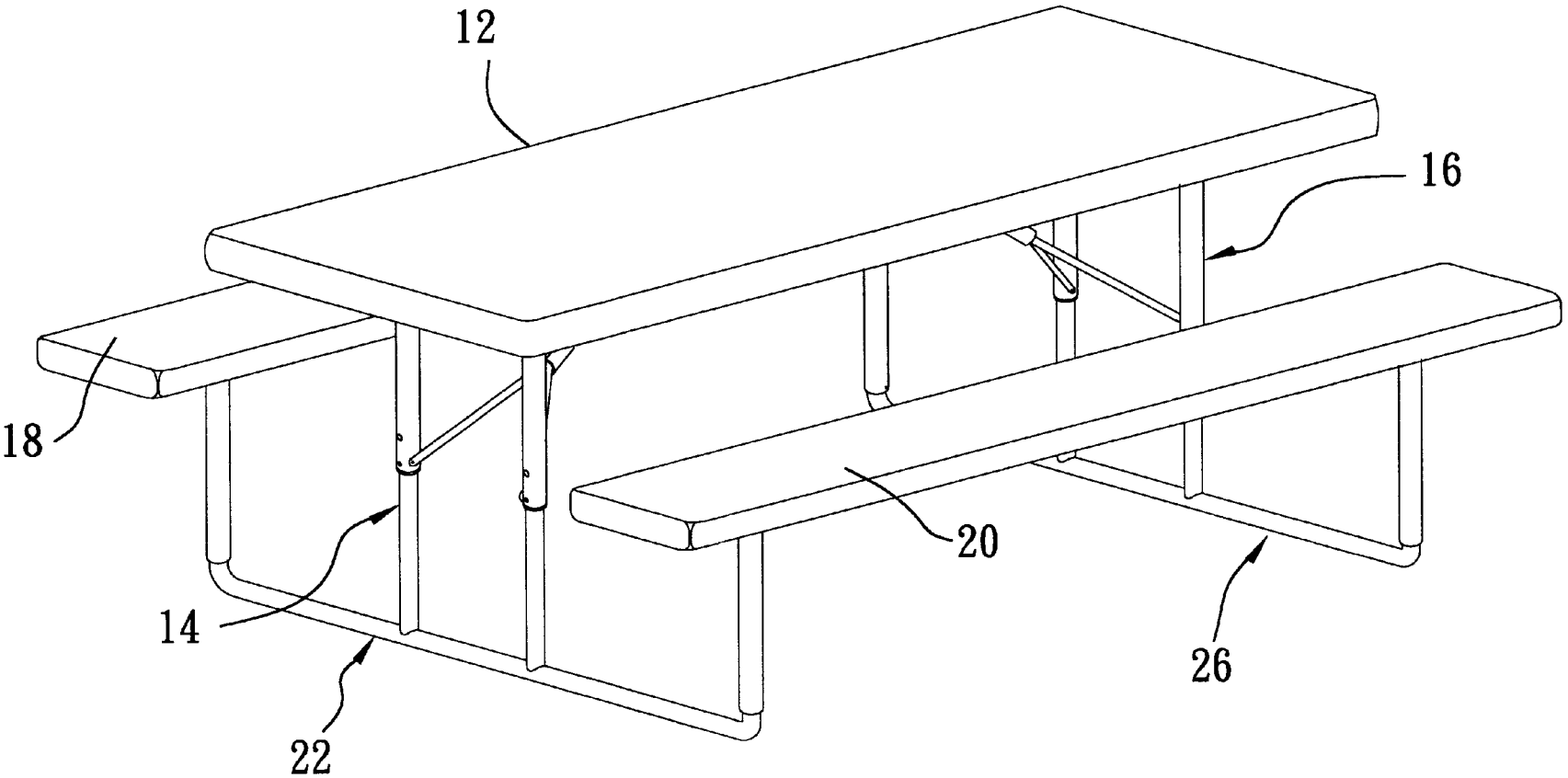
FIG. 1 PRIOR ART
FIG. 1 is a perspective view of a conventional picnic table in a picnic table configuration.
Figure 2:
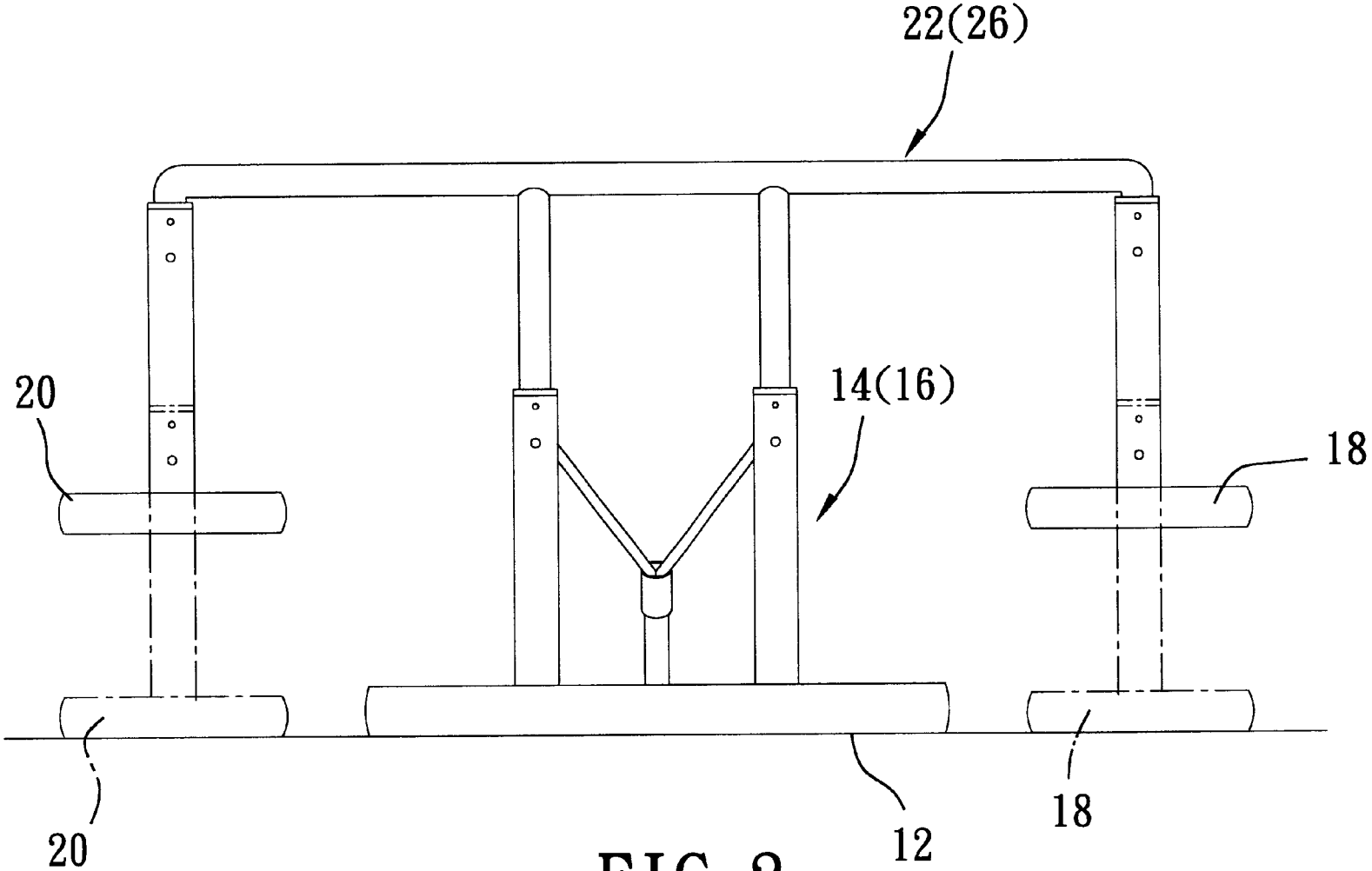
FIG. 2 PRIOR ART
FIG. 2 is a plan end view of the picnic table of FIG. 1 in an inverted state.
Figure 3:
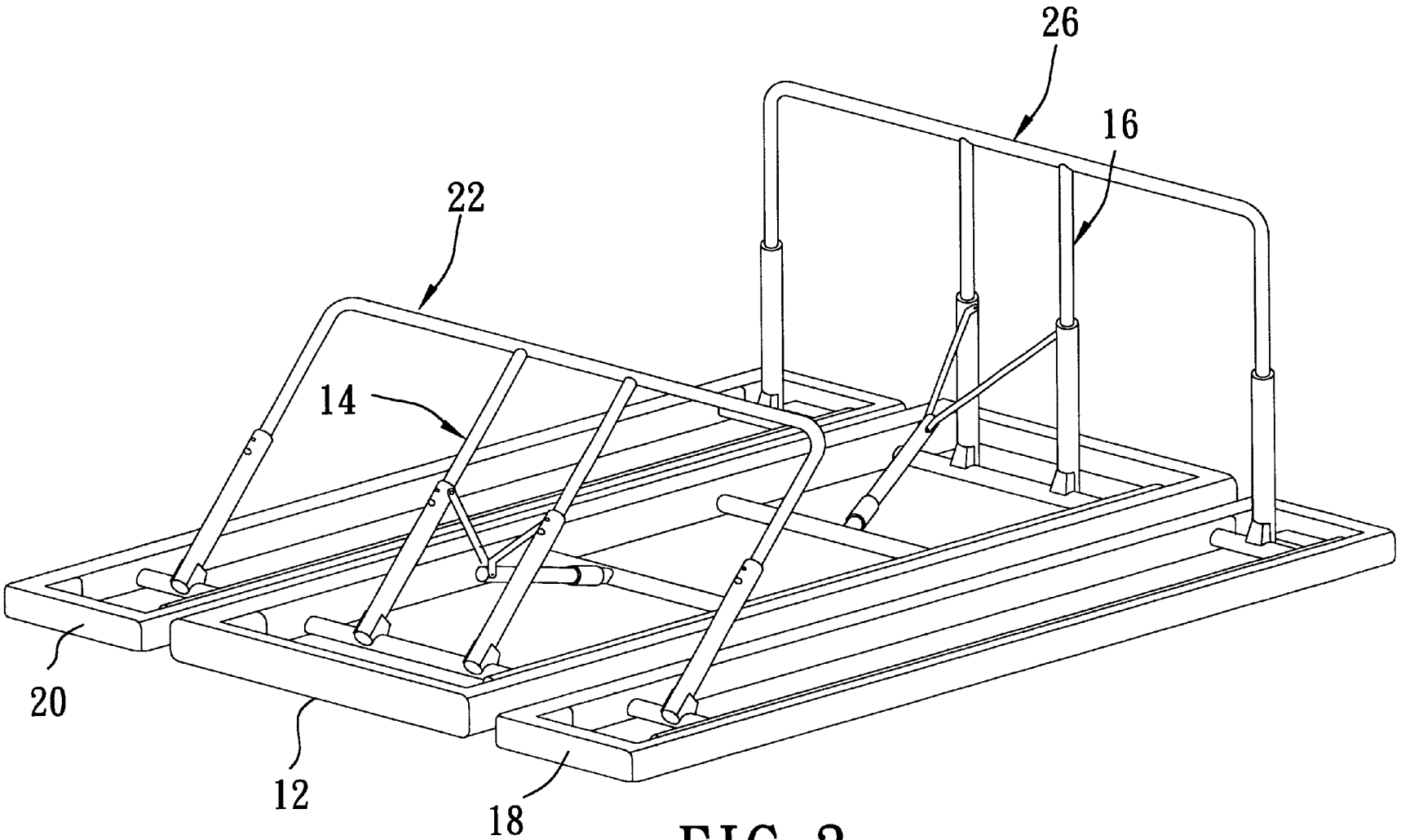
FIG. 3 PRIOR ART
FIG. 3 is a perspective view of the inverted picnic table FIG. 1 during a folding operation.
Figure 4:
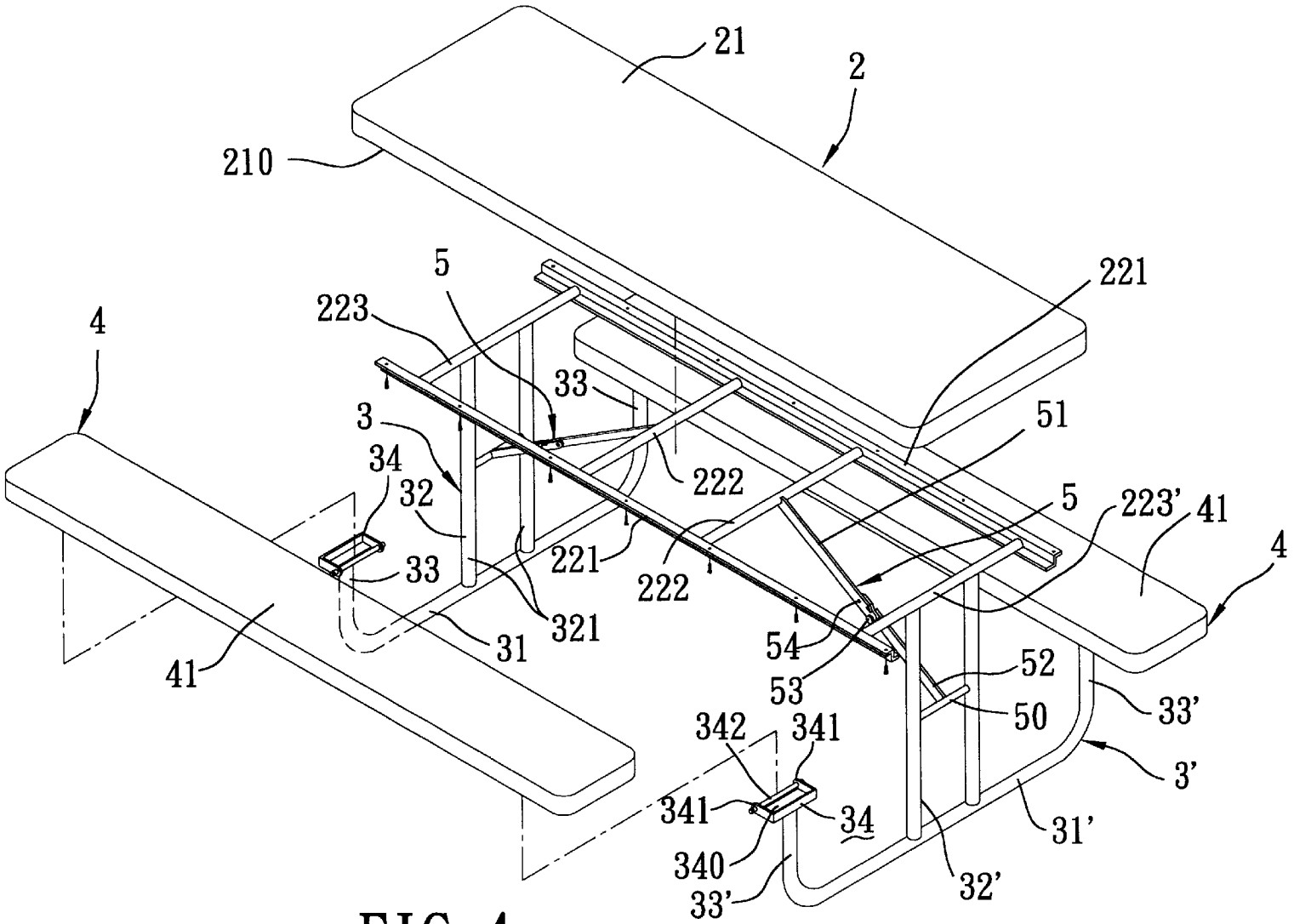
FIG. 4 is a partly exploded perspective view of a preferred embodiment of the table and bench assembly of the present invention.
Figure 5:
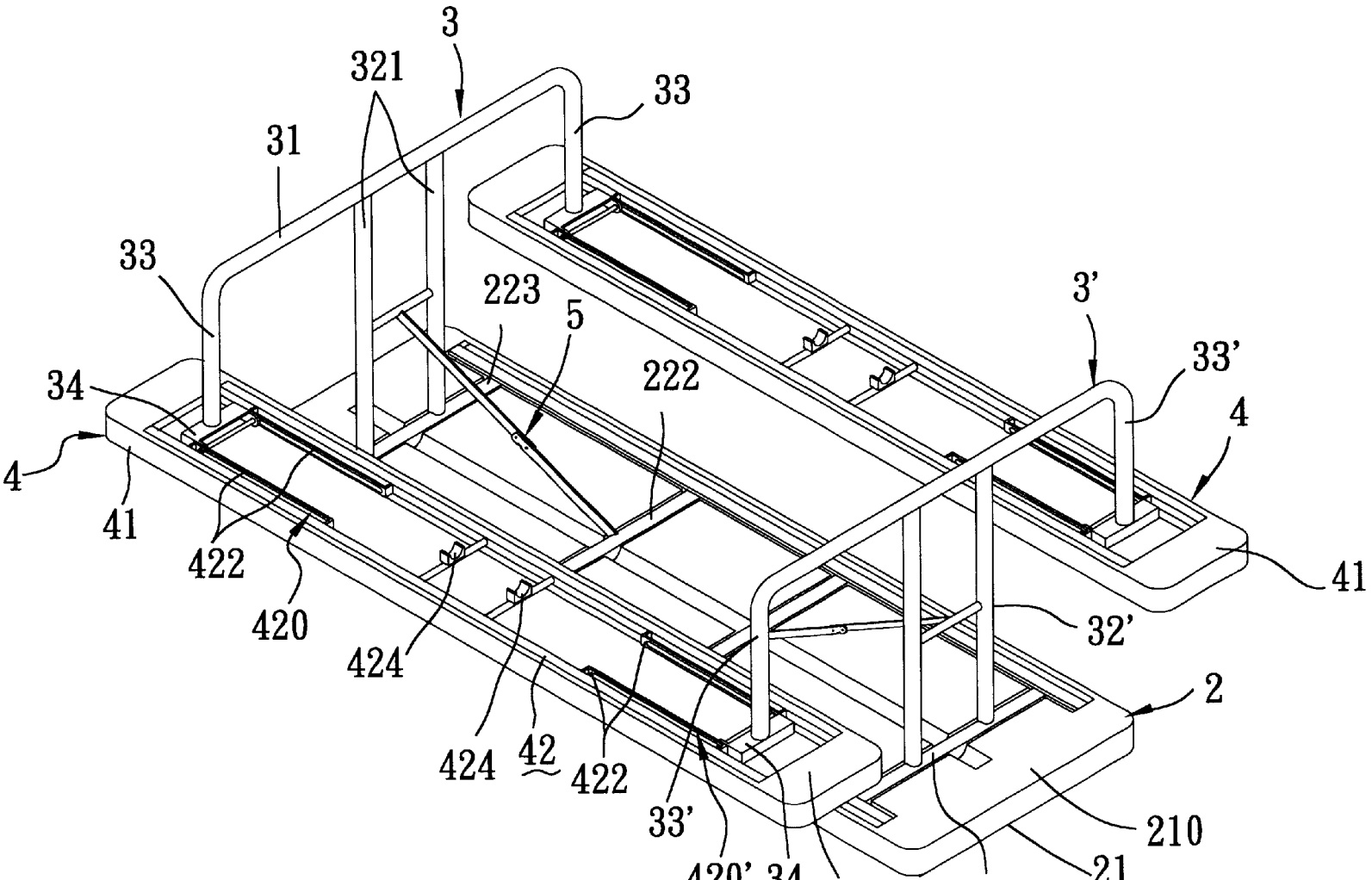
FIG. 5 is an inverted perspective view of the preferred embodiment in an unfolded state.

Referring to FIGS. 4 and 5, the preferred embodiment of the foldable table and bench assembly according to the present invention is shown to include a table top unit 2, a pair of lateral bench units 4, front and rear leg units 3, 3', and a pair of foldable linking units 5.

The table top unit 2 includes a horizontally disposed elongated table top panel 21 and a parallel pair of horizontal bars 221 fixed to a bottom side surface 210 of the panel 21.

The horizontal bars 221 and the panel 21 extend in a horizontal first direction. The bars 221 have front and rear end portions which are opposite to each other in the first direction. The table top unit 2 has two opposite lateral sides which are opposite to each other in a horizontal second direction transverse to the first direction.

The bench units 4 are disposed on the lateral sides of the table top unit 2 at a level lower than the table top unit 2. Each of the bench units 4 includes a horizontally disposed, elongated bench panel 41 which extends in the first direction, and an elongated seat frame 42 mounted on a bottom side surface 410 of the bench panel 41. The seat frame 42 is provided with front and rear slide rail units 420, 420' which are disposed respectively at front and rear end portions of the seat frame 42. Each of the slide rail units 420, 420' consists of a parallel pair of slide rails 422, each of which is formed with a slide groove 423 (see FIG. 6) that extends in the first direction. The seat frame 42 is further formed with a pair of clips 424 at an intermediate portion thereof between the front and rear end portions.

Figure 6:
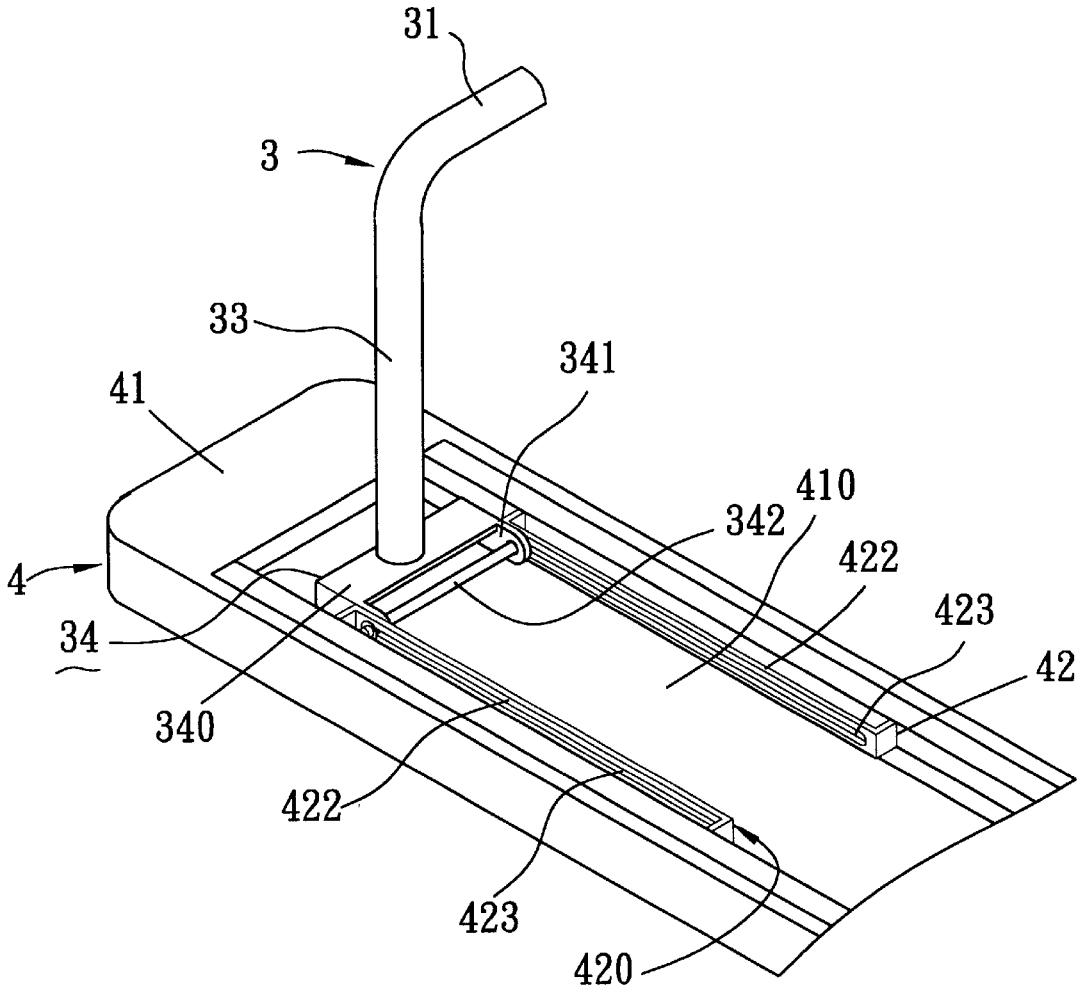
FIG. 6 is a fragmentary, partly enlarged view of FIG. 5.

The front leg unit 3 includes a pair of outer leg portions 33 and an inner leg portion 32 disposed between the outer leg portions 33. Each of the outer leg portions 33 has an upper end provided with a slide seat 34 that is mounted slidably and pivotally on the front slide rail unit 420 of the seat frame 42 of a respective one of the bench units 4. Referring to FIG. 6, the slide seat 34 includes a main body 340 fixed to the upper end of the respective one of the outer leg portions 33 and disposed between the slide rails 422 of the front slide rail unit 420, and a pivot shaft 342 mounted rotatably on a pair of pivot lobes 341 that project integrally from the main body 340. The pivot shaft 342 has an axis transverse to the first direction, and two opposite ends which extend respectively into and which are slidable along the slide grooves 423 of the front slide rail unit 420. The main body 340 and the corresponding outer leg portion 33 are turnable about the pivot shaft 342, and are thus pivotable toward and away from the bottom side surface 410 of the bench panel 41.

Referring back to FIGS. 4 and 5, the inner leg portion 32 of the front leg unit 3 includes a parallel pair of leg members 321 spaced apart from each other and parallel to the outer leg portions 33. The inner leg portion 32 has an upper end formed with a mounting rod 223 which extends in the second direction between the horizontal bars 221 of the table top unit 2 and which is mounted rotatably on the horizontal bars 221 at the front end portions of the horizontal bars 221 such that the front leg unit 3 is mounted pivotally on the table top unit 2 and is thus pivotable relative to the table top unit 2 about an axis of the mounting rod 223. The front leg unit 3 further includes a bottom connecting rod 31 interconnecting lower ends of the inner and outer leg portion 32, 33 and adapted to be disposed on a ground surface.

The rear leg unit 3' has a structure similar to that of the front leg unit 3, and is spaced apart from the front leg unit 3 in the first direction. The rear leg unit 3' includes a pair of outer leg portions 33', each of which has an upper end provided with a slide seat 34 that is mounted slidably and pivotally on the rear slide rail unit 420' of a respective one of the bench units 4 in a manner similar to the slide seats 34 on the front leg unit 3, and an inner leg portion 32' that has an upper end mounted pivotally on the rear end portions of the horizontal bars 221 in a manner similar to that of the inner leg portion 32 of the front leg unit 3 such that each of the outer leg portions 33' is slidable along the rear slide rail unit 420' of the respective bench unit 4 and is pivotable relative to the rear slide rail unit 420' about an axis parallel to the axis of the pivot shaft 342 on a respective slide seat 34 of the front leg unit 3, and such that the inner leg portion 32' is pivotable relative to the table top unit 2 about an axis of a mounting rod 223' on the inner leg portion 32' parallel to the mounting rod 223 on the front leg unit 3.

One of the linking units 5 extends between an intermediate portion of the table top unit 2 and the inner leg portion 32 of the front leg unit 3. The other one of the linking units 5 extends between the intermediate portion of the table top unit 2 and the inner leg portion 32' of the rear leg unit 3'. Each of the linking units 5 includes an elongated first linking plate 51, an upper pivot rod 222 secured to an upper end of the first linking plate 51, a second linking plate 52 having an upper end pivoted to a lower end of the first linking plate 51, and a lower pivot rod 50 secured to a lower end of the second linking plate 52. The upper and lower pivot rods 222, 50 extend in the second direction and are transverse to the first and second linking plates 51, 52. The upper pivot rod 222 extends between the horizontal bars 221 of the table top unit 2 at a respective one of the front and rear end portions of the table top unit 2, and is mounted rotatably on the horizontal bars 221 for mounting pivotally the first linking plate 51 to the table top unit 2. The lower pivot rod 50 extends between the leg members 321 of the inner leg portion 32, and is mounted rotatably on the leg members 321 for connecting pivotally the second linking plate 52 to the inner leg portion 32.

Figure 9:
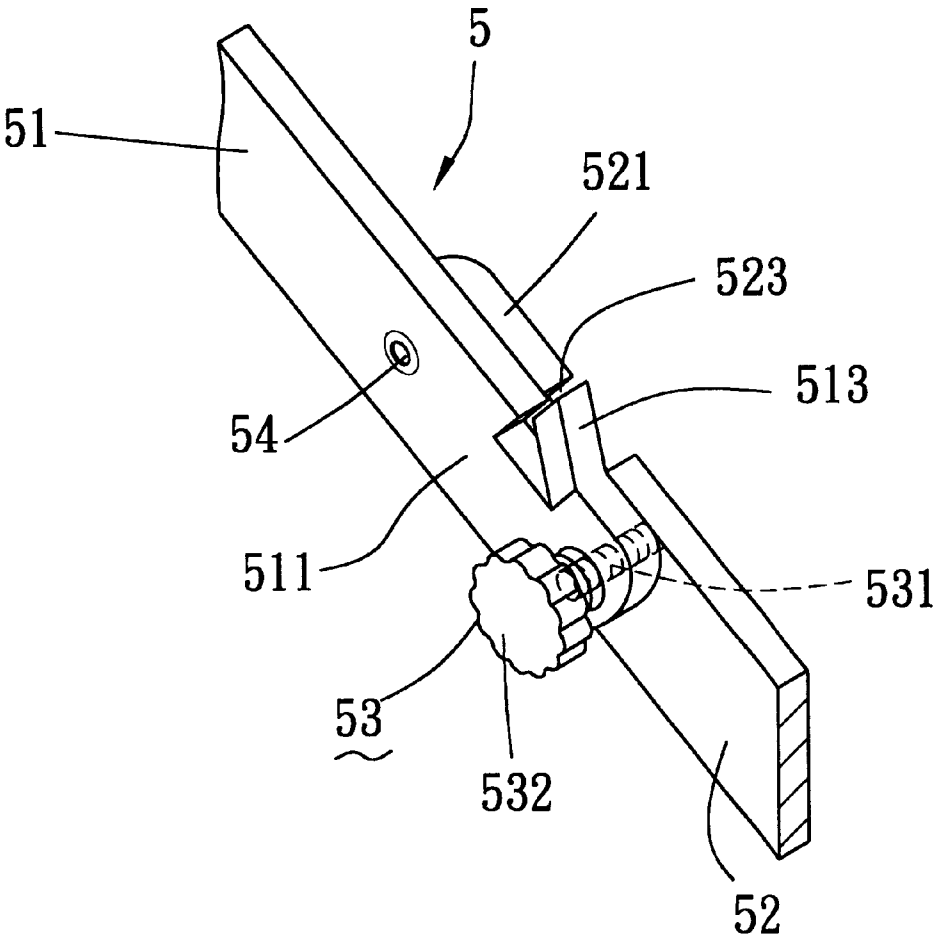
FIG. 9 is a fragmentary perspective view showing a linking unit of the preferred embodiment in an unfolded state.
Figure 10:
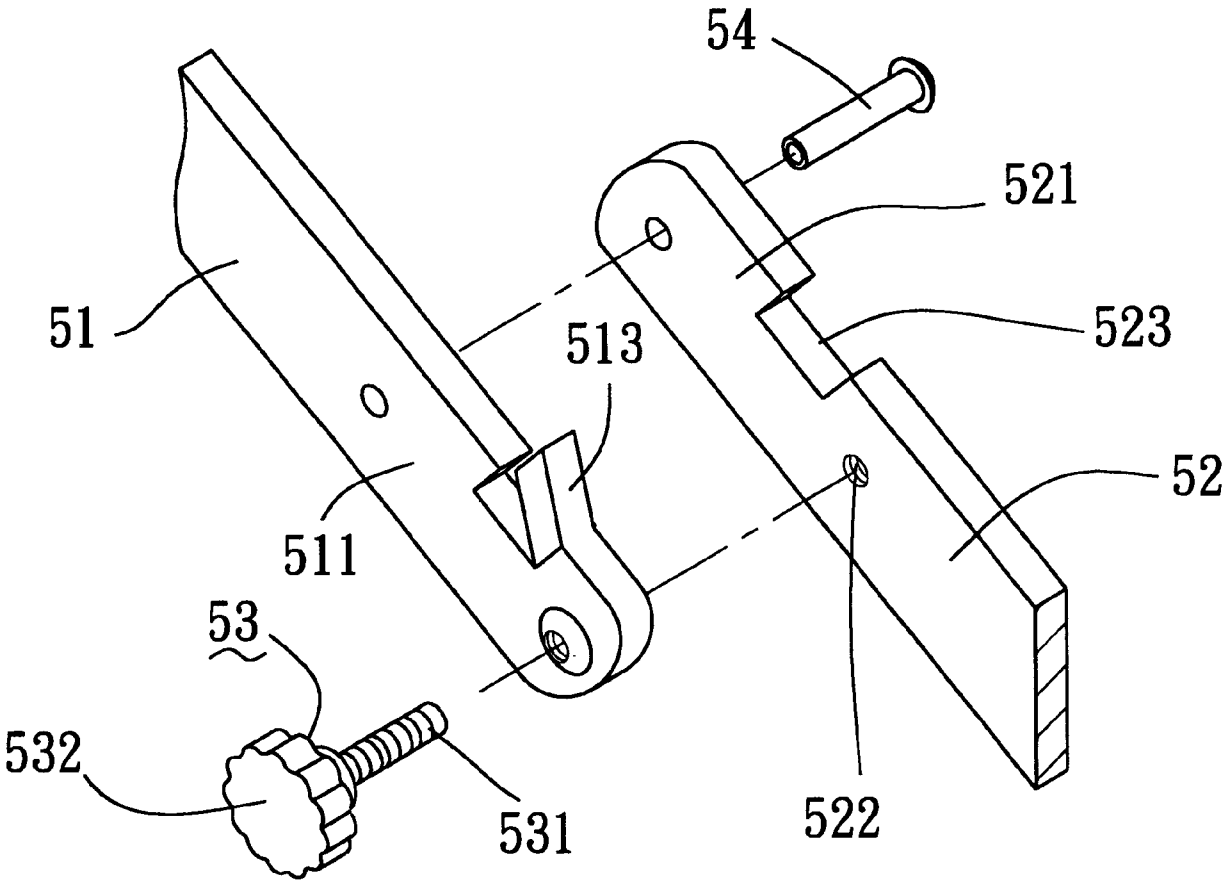
FIG. 10 is an exploded fragmentary perspective view illustrating the linking unit of FIG. 9.
Figure 11:
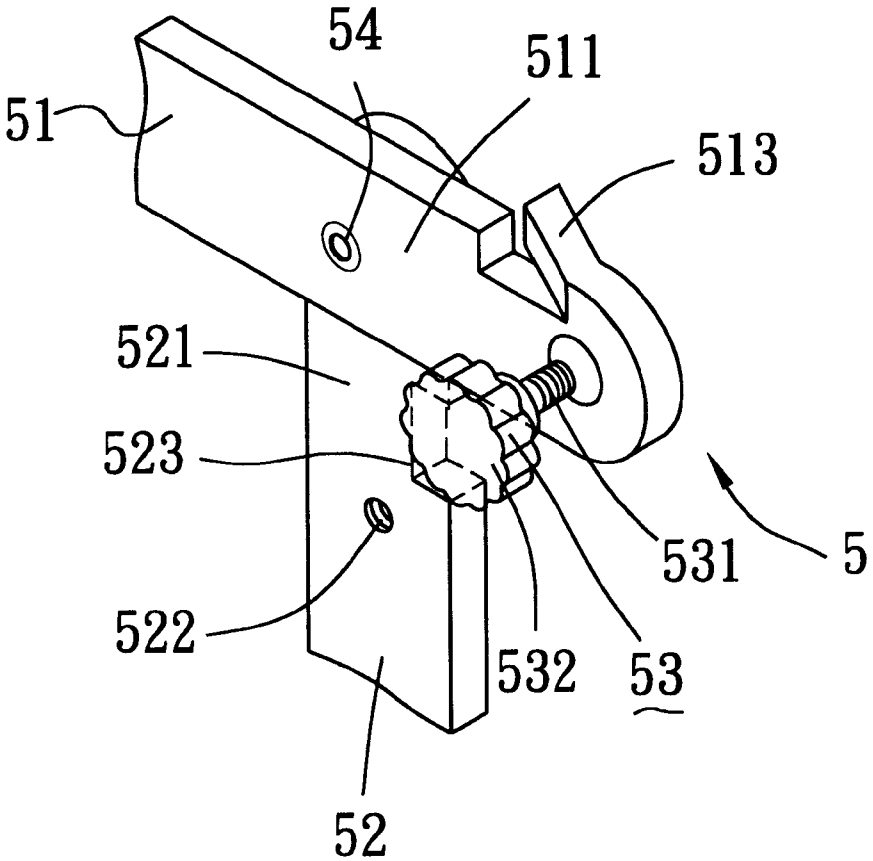
FIG. 11 is a fragmentary perspective view of the linking unit during a folding operation.

Referring to FIGS. 9 and 10, each of the linking units 5 further includes a locking member 53 for locking the second linking plate 52 to the first linking plate 51 in an unfolded state, in which the first and second linking plates 51, 52 are unfolded from each other and cooperatively form a 180 degree angle. The locking member 53 is located to be displaced, along the length of the first linking plate 51, from a pivot pin 54 that connects pivotally the first and second linking plates 51, 52. The locking member 53 includes a threaded rod 531 extendible threadedly through the first and second linking plates 51, 52 when the first and second linking plates 51, 52 are unfolded from each other, and a rotary knob 532 fixed to one end of the threaded rod 531. When the threaded rod 531 extends threadedly through the first and second linking plates 51, 52, the first and second linking plates 51, 52 are locked to each other in the unfolded position to prevent untimely folding of the first and second linking plates 51, 52 toward each other. The rotary knob 532 is operable for unthreading and removal of the threaded rod 531 from a threaded hole 522 in the second linking plate 52 so as to unlock one of the first and second linking plates 52 from the other, thereby permitting relative pivoting movement of the first and second linking plates 51, 52 about an axis of the pivot pin 54. The lower end 511 of the first linking plate 51 is formed with a retaining projection 513. The upper end 521 of the second linking plate 52 is formed with a notch 523 that opens at an upper edge of the second linking plate 52. When the second linking plate 52 is turned pivotally relative to the first linking plate 51 in a direction for folding toward the first linking plate 51, the notch 523 is moved away from the retaining projection 513, as shown in FIG. 11. When the second linking plate 52 is turned pivotally in an opposite direction for unfolding from the first linking plate 51 and is then moved to the unfolded position, the retaining projection 513 extends into the notch 523 and abuts against a notch-defining wall that defines the notch 523 in the second linking plate 52, thereby preventing further pivoting movement of the second linking plate 52 relative to the first linking plate 51 after the first and second linking plates 51, 52 are disposed at the unfolded position.

Figure 7:
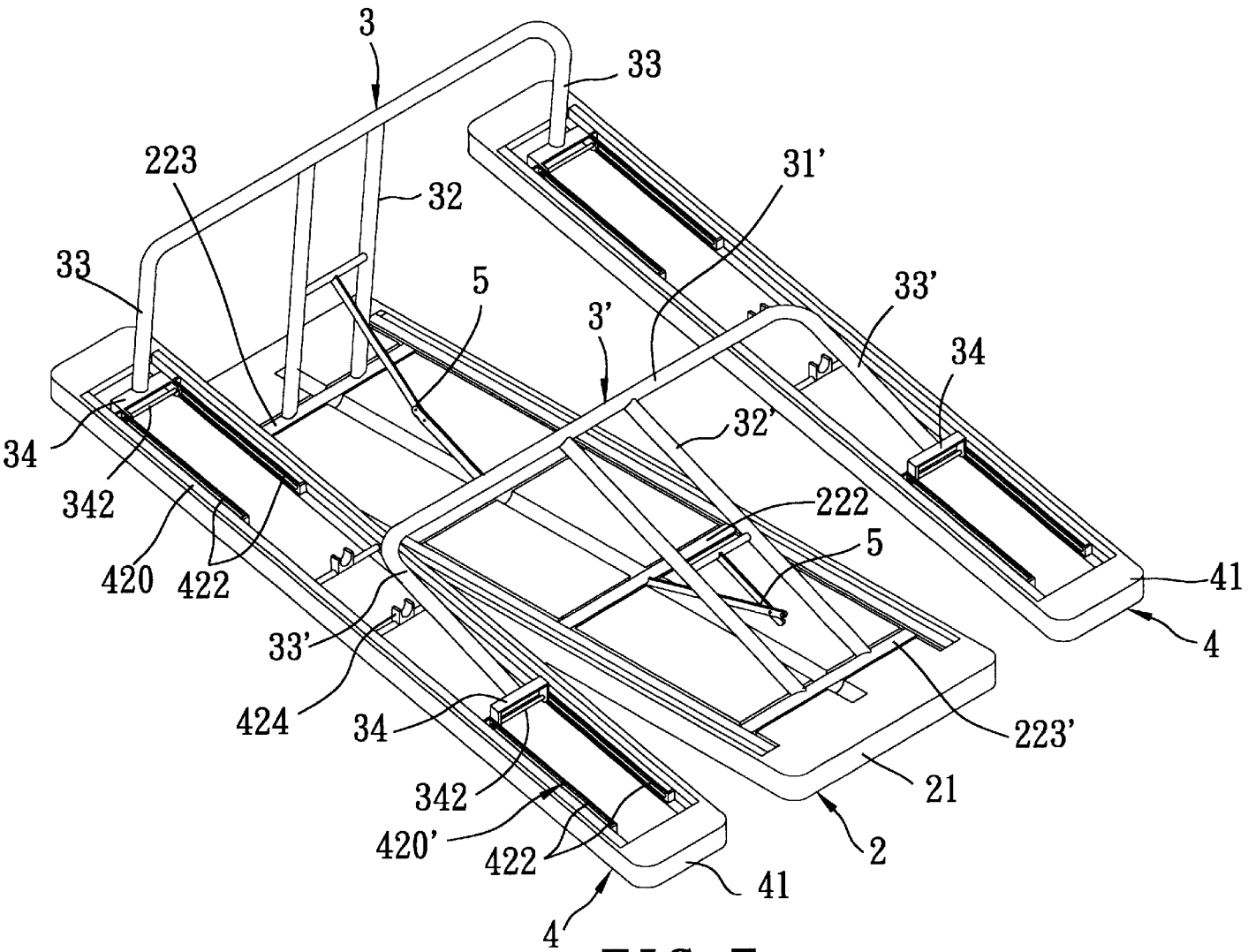
FIG. 7 is an inverted perspective view of the preferred embodiment during a folding operation.
Figure 8:
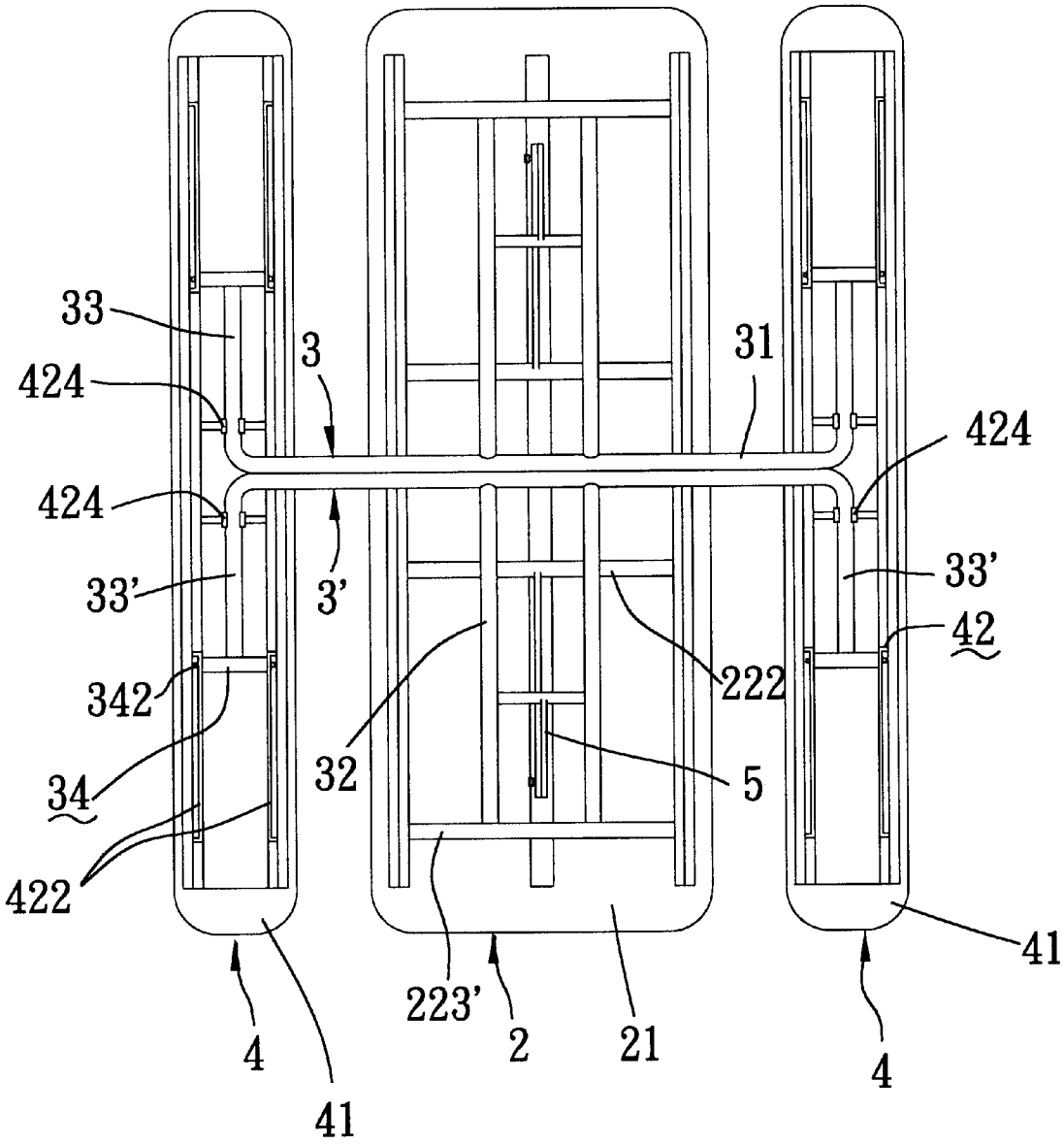
FIG. 8 is a bottom view of the preferred embodiment in a folded state.
Figure 12:
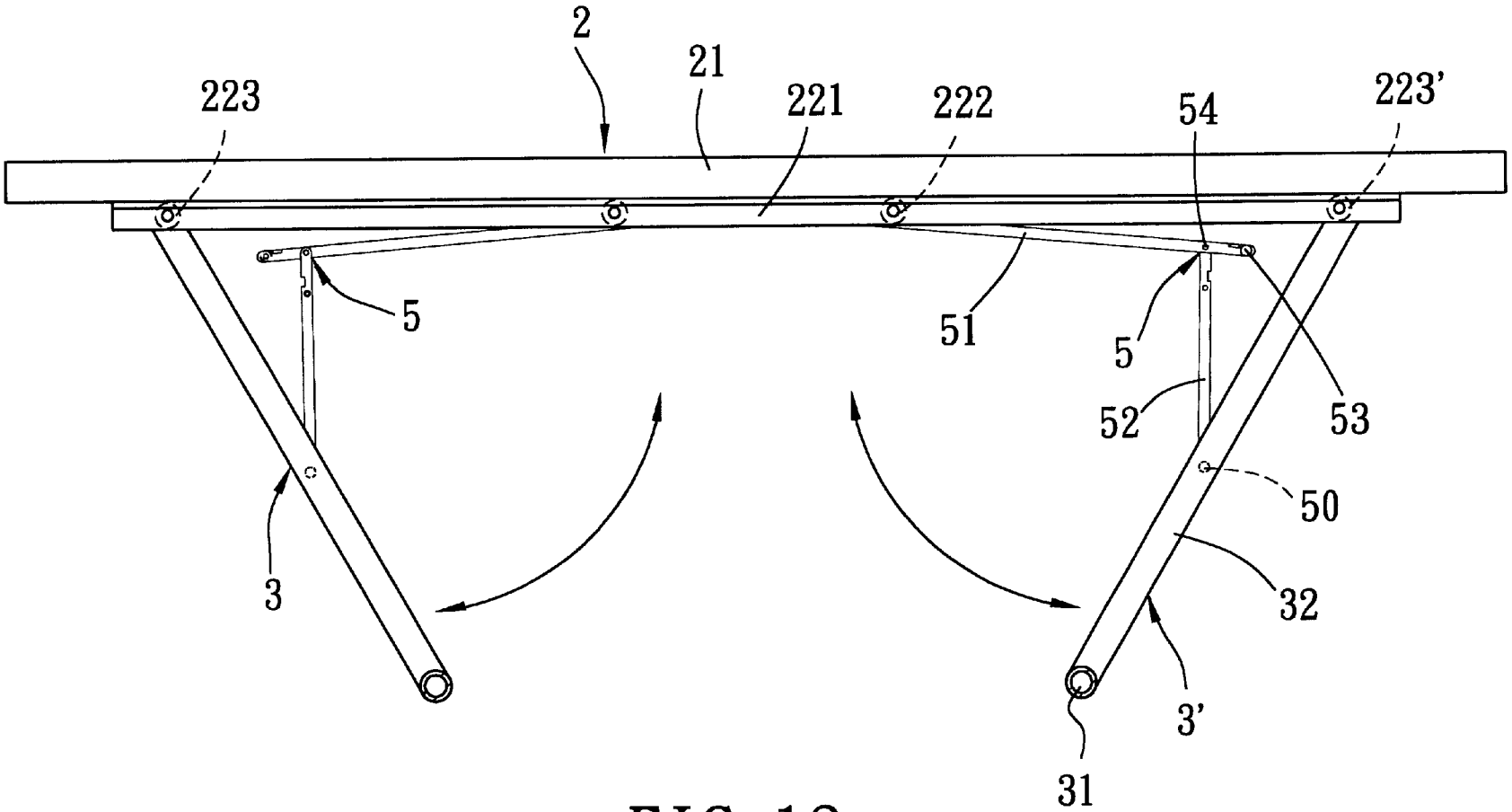
FIG. 12 is a side view of the table and bench assembly of the preferred embodiment during a folding operation, where two bench units are removed for the sake of clarity.

Referring back to FIG. 4, when the front and rear leg units 3, 3' are in an unfolded position, the front and rear leg units 3, 3' are disposed uprightly to place the bottom connecting rods 31, 31' thereof on the ground surface, the linking units 5 are in the unfolded position, in which the first and second linking plates 51, 52 are unfolded from each other to form a 180 degree angle, and the table top unit 2 is disposed higher than the bench units 4. At this time, the locking members 53 on the linking units 5 are operable to lock the linking units 5 in the unfolded position so as to prevent untimely folding of the table and bench assembly. Referring to FIGS. 5 and 7, to fold the table and bench assembly, the locking members 53 are operated to unlock the second linking plates 52 from the first linking plates 51 so as to permit folding of the linking units 5. With further reference to FIG. 12, when the linking units 5 are moved toward the folded position, the front and rear leg units 3, 3' are pulled inwardly by the linking units 5 and are turned pivotally toward the bottom side surface 210 of the table top panel 21. During the turning movement of the front and rear leg units 3, 3', the slide seat 34 on the upper end of each of the outer leg portions 33, 33' of the front and rear leg units 3, 3' slides along the corresponding one of the front and rear rail units 420, 420' toward the intermediate portion of the corresponding bench unit 4. Thereafter, the outer leg portions 33, 33' are turned about axes of the pivot shafts 342 on the slide seats 34 for folding on the bottom side surface 410 of the bench panels 41. The inner leg portions 32, 32' are turned about axes of the mounting rods 223, 223' for folding on the bottom side surface 210 of the table top panel 21. Finally, as shown in FIG. 8, each of the outer leg portions 33, 33' is clamped removably by a respective one of the clips 424 on the bench units 4 for retaining releasably the front and rear leg units 3, 3' in the folded position. In the folded state of the table and bench assembly, the table top panel 21 is generally disposed in the same plane as the bench panels 41.

It is noted that, in the present embodiment, the inner leg portion 32, 32' is longer than the outer leg portions 33, 33' of each of the front and rear leg units 3, 3'. The slide grooves 423 in each of the front and rear slide rails 420, 420' has a length which is approximately equal to the difference between the lengths of the inner and outer leg portions 32(32'), 33(33').

With the provision of the slide seats 34 that automatically slide along the slide rail units 420, 420' during the folding operation of the table and bench assembly of the present invention, the table and bench assembly can be easily folded through a relatively simplified folding operation. An adjustment operation for adjusting relative positions of the table unit and the bench units before folding of the leg units is unnecessary.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable table and bench assembly, comprising:

a table top unit having front and rear end portions which are opposite to each other in a horizontal first direction, and opposite lateral sides which are opposite to each other in a horizontal second direction transverse to the first direction;

a pair of bench units disposed on the lateral sides of said table top unit, each of said bench units having front and rear end portions which are opposite to each other in the first direction and which are provided respectively with front and rear slide rail units, each of said front and rear slide rail units being formed with a parallel pair of slide grooves that extend in the first direction;

a front leg unit including a pair of outer leg portions, each of which has an upper end provided with a slide seat that is mounted slidably and pivotally on said front slide rail unit of a respective one of said bench units so as to be slidable along said slide grooves in said front slide rail unit and so as to be pivotable relative to said front slide rail unit about a horizontal first pivot axis transverse to said first direction, said front leg unit further including an inner leg portion disposed between said outer leg portions, said inner leg portion having an upper end pivoted to said front end portion of said table top unit so as to be pivotable about a horizontal second pivot axis parallel to said first pivot axis, said front leg unit further including a connecting rod interconnecting said inner and outer leg portions of said front leg unit;

a rear leg unit which is spaced apart from said front leg unit in the first direction, said rear leg unit including a pair of outer leg portions, each of which has an upper end provided with a slide seat that is mounted slidably and pivotally on said rear slide rail unit of a respective one of said bench units so as to be slidable along said slide grooves in said rear slide rail unit and so as to be pivotable about a horizontal third pivot axis parallel to said first pivot axis, said rear leg unit further including an inner leg portion disposed between said outer leg portions of said rear leg unit, said inner leg portion of said rear leg unit having an upper end pivoted to said rear end portion of said table top unit so as to be pivotable about a horizontal fourth pivot axis parallel to said second pivot axis, said rear leg unit further including a connecting rod interconnecting said inner and outer leg portions of said rear leg unit;

said front and rear leg units being turnable pivotally between an unfolded position, in which said front and rear leg units are disposed uprightly and in which said table top unit is disposed higher than said bench units, and a folded position, in which said front and rear leg unit are folded on said table top unit and said bench units, said slide seats on said front and rear leg units being slidable along said front and rear rail units when said front and rear leg units are moved from the unfolded position to the folded position.

2. The foldable table and bench assembly as claimed in claim 1, wherein said table top unit includes a horizontally disposed table top panel with a bottom side surface, and a parallel pair of horizontal bars which extend in the first direction and which are fixed to said bottom side surface of said table top panel, said upper end of said inner leg portion of each of said front and rear leg units being formed with a mounting rod which extends in the second direction between said horizontal bars and which is mounted rotatably on said horizontal bars for mounting pivotally said inner leg portion to said table top unit.

3. The foldable table and bench assembly as claimed in claim 1, wherein said table top unit further has an intermediate portion between said front and rear end portions, said table and bench assembly further comprising a pair of foldable linking units, each of which includes a first linking plate that has an upper end pivoted to said intermediate portion of said table top unit and a lower end opposite to said upper end, and a second linking plate having an upper end pivoted to said lower end of said first linking plate and a lower end pivoted to said inner leg portion of a respective one of said front and rear leg units, said first and second linking plates of said linking units being unfolded from each other when said front and rear leg units are disposed in the unfolded position, said first and second linking plates of said linking units being folded toward each other when said front and rear leg units are disposed in the folded position, one of said first and second linking plates being formed with a retaining projection, the other one of said first and second linking plates having an indented notch-defining wall that defines a notch, said retaining projection extending into said notch and abutting against said notch-defining wall when said first and second linking plate are moved to the unfolded position.

4. The foldable table and bench assembly as claimed in claim 3, wherein each of said linking units further includes a locking member which is extendible through said first and second linking plates for locking said first linking plate to said second linking plate when said first and second linking plates are unfolded from each other for locking said linking unit in the unfolded position and so as to lock the corresponding one of said front and rear leg units in the unfolded position, said locking member being operable for removal from one of said first and second linking plates in order to unlock said one of said first and second linking plates from the other of said first and second linking plates, thereby permitting said first and second linking plates to be folded toward each other and thereby permitting the corresponding one of said front and rear leg units to be moved to the folded position.

5. The foldable table and bench assembly as claimed in claim 4, wherein said locking member of each of said linking units includes a threaded rod extending threadedly through said lower end of said first linking plate and through said upper end of said second linking plate, and a rotary knob fixed to one end of said threaded rod, said rotary knob being operable for unthreading said threaded rod from one of said first and second linking plates so as to unlock said one of said first and second linking plates from the other of said first and second linking plates.

6. The foldable table and bench assembly as claimed in claim 3, wherein said table top unit includes a horizontally disposed table top panel with a bottom side surface, and a parallel pair of horizontal bars which extend in the first direction and which are fixed to said bottom side surface of said table top panel, said upper end of said first linking plate being formed with an upper pivot rod which extends in the second direction between said horizontal bars and which is mounted rotatably on said horizontal bars for mounting pivotally said upper end of said first linking plate to said table top unit.

7. The foldable table and bench assembly as claimed in claim 3, wherein said inner leg portion of each of said front and rear leg units includes a parallel pair of leg members, said lower end of said second linking plate of each of said linking units being formed with a lower pivot rod which extends in the second direction between said leg members of said inner leg portion of a respective one of said front and rear leg units and which is mounted rotatably thereon for mounting pivotally said second linking plate to said inner leg portion of the respective one of said front and rear leg units.

8. The foldable table and bench assembly as claimed in claim 1, wherein said slide seat on each of said outer leg portions of each of said front and rear leg units includes a main body fixed to a respective one of said outer leg portions of said front and rear leg units, and a pivot shaft mounted rotatably on said main body, said pivot shaft having two opposite ends extending respectively into and slidable along said slide grooves in a corresponding one of said front and rear slide rail units of said bench units.

9. The foldable table and bench assembly as claimed in claim 1, wherein each of said bench units includes a horizontally disposed bench panel with a bottom side surface that is provided with a pair of clips which are disposed between said front and rear rail units for clamping removably said outer leg portions of said front and rear leg units when said front and rear leg units are moved to the folded position, thereby retaining releasably said front and rear leg units in the folded position.

* * * * *